US010842184B2

(12) United States Patent
Kadiric

(10) Patent No.: US 10,842,184 B2
(45) Date of Patent: Nov. 24, 2020

(54) AEROSOL GENERATING ARTICLE HAVING MOUTHPIECE WITH SURFACE FORMATIONS AND REMOVABLE TIPPING WRAPPER PORTION

(71) Applicant: PHILIP MORRIS PRODUCTS S.A., Neuchatel (CH)

(72) Inventor: Alen Kadiric, Orpund (CH)

(73) Assignee: Philip Morris Products S.A., Neuchatel (CH)

( * ) Notice: Subject to any disclaimer, the term of this patent is extended or adjusted under 35 U.S.C. 154(b) by 114 days.

(21) Appl. No.: 15/569,225

(22) PCT Filed: Mar. 24, 2016

(86) PCT No.: PCT/EP2016/056569
§ 371 (c)(1),
(2) Date: Oct. 25, 2017

(87) PCT Pub. No.: WO2016/188649
PCT Pub. Date: Dec. 1, 2016

(65) Prior Publication Data

US 2018/0295875 A1 Oct. 18, 2018

(30) Foreign Application Priority Data

May 22, 2015 (EP) ..... 15169049

(51) Int. Cl.
*A24D 1/02* (2006.01)
*A24D 3/04* (2006.01)
*A24D 1/04* (2006.01)

(52) U.S. Cl.
CPC ..... *A24D 1/02* (2013.01); *A24D 1/042* (2013.01); *A24D 1/045* (2013.01); *A24D 3/04* (2013.01)

(58) Field of Classification Search
CPC ..... A24D 1/02; A24D 1/04; A24D 1/042
(Continued)

(56) References Cited

U.S. PATENT DOCUMENTS 3,260,266 A 7/1966 Miller
4,727,892 A * 3/1988 Abdelgawad ..... A24D 3/041 131/198.2
(Continued)

FOREIGN PATENT DOCUMENTS

CN 2699686 5/2005
CN 102227174 10/2011
(Continued)

OTHER PUBLICATIONS

European Extended Search Report for Application No. 15169049.2 dated Dec. 4, 2015 (6 pages).
(Continued)

*Primary Examiner* — Eric Yaary
(74) *Attorney, Agent, or Firm* — Mueting Raasch Group

(57) ABSTRACT

There is provided an aerosol generating article (10) comprising an aerosol generating substrate (12), a mouthpiece (14) in axial alignment with the aerosol generating substrate (12), and a tipping wrapper (20) wrapped around the mouthpiece (14) and at least a portion of the aerosol generating substrate (12). The mouthpiece (14) comprises a mouthpiece wrapper (30) circumscribing one or more mouthpiece segments (16). The tipping wrapper (20) comprises at least one weakening line (22) extending transversely around at least a portion of the tipping wrapper (20); an upstream wrapper portion (24) extending upstream from the at least one weakening line; and a removable tipping wrapper portion (26) extending downstream from the at least one weakening
(Continued)

line (22). The mouthpiece wrapper (30) comprises at least one surface formation (28) underlying the removable tipping wrapper portion (26).

13 Claims, 4 Drawing Sheets

(58) Field of Classification Search
USPC ..... 131/331
See application file for complete search history.

(56) References Cited

U.S. PATENT DOCUMENTS

| | | | | |
|---|---|---|---|---|
| 2002/0053350 | A1* | 5/2002 | Tani | A24D 1/02 131/360 |
| 2007/0095357 | A1 | 5/2007 | Besso | |
| 2008/0029111 | A1* | 2/2008 | Dube | A24C 5/471 131/280 |
| 2010/0108084 | A1 | 5/2010 | Norman | |
| 2015/0296878 | A1* | 10/2015 | Mucalo | A24D 1/002 131/335 |

FOREIGN PATENT DOCUMENTS

| | | |
|---|---|---|
| CN | 203446522 | 2/2014 |
| DE | 19527471 | 1/1997 |
| EP | 0193670 | 9/1986 |
| EP | 0664089 | 7/1995 |
| EP | 2002737 | 12/2008 |
| EP | 2888955 | 7/2015 |
| GB | 2479775 | 10/2011 |
| JP | S56-158197 | 4/1955 |
| JP | 2012-507287 | 3/2012 |
| WO | WO 2009/000179 | 12/2008 |
| WO | WO 2012/076649 | 6/2012 |

OTHER PUBLICATIONS

International Search Report and Written Opinion for PCT/EP2016/056569 dated Jun. 9, 2016 (10 pages).
Office Action issued in Russia for Application No. 2017141570 dated Apr. 30, 2019 (17 pages). English translation included.
Office Action issued in China for Application No. 201680026911.9 dated Dec. 4, 2019 (18 pages). English translation included.
Office Action issued in Japan for Application No. 2017-559642 dated Mar. 30, 2020 (6 pages). English translation included.

* cited by examiner

AEROSOL GENERATING ARTICLE HAVING MOUTHPIECE WITH SURFACE FORMATIONS AND REMOVABLE TIPPING WRAPPER PORTION

This application is a U.S. National Stage Application of International Application No. PCT/EP2016/056569, filed Mar. 24, 2016, which was published in English on Dec. 1, 2016, as International Publication No. WO 2016/188649 A1. International Application No. PCT/EP2016/056569 claims priority to European Application No. 15169049.2 dated May 22, 2015.

The present invention relates to an aerosol generating article having a mouthpiece with surface formations and a removable tipping wrapper portion.

Filter cigarettes typically comprise a cylindrical rod of tobacco cut filler surrounded by a paper wrapper and a cylindrical filter axially aligned in an abutting end-to-end relationship with the wrapped tobacco rod. The cylindrical filter typically comprises a filtration material circumscribed by a paper plug wrap. Conventionally, the wrapped tobacco rod and the filter are joined by a band of tipping wrapper that normally circumscribes the entire length of the filter and an adjacent portion of the wrapped tobacco rod. A conventional filter cigarette is typically smoked by lighting the end of the cigarette opposite the mouthpiece so that the tobacco rod burns.

A number of aerosol generating articles in which tobacco is heated rather than combusted have also been proposed in the art. In heated aerosol generating articles, an aerosol is generated by heating a flavour generating substrate, such as tobacco. Known heated aerosol generating articles include, for example, electrically heated aerosol generating articles and aerosol generating articles in which an aerosol is generated by the transfer of heat from a combustible fuel element or heat source to a physically separate aerosol forming material. During smoking, volatile compounds are released from the aerosol forming substrate by heat transfer from the fuel element and entrained in air drawn through the aerosol generating article. As the released compounds cool they condense to form an aerosol that is inhaled by the consumer. Also known are aerosol generating articles in which a nicotine-containing aerosol is generated from a tobacco material, tobacco extract, or other nicotine source, without combustion, and in some cases without heating, for example through a chemical reaction.

When smoking a smoking article, consumers typically have limited choice, if any, over how they use the smoking article to deliver a smoking experience; the smoking experience delivered by a smoking article is often determined at the time of manufacture of the smoking article.

It would be desirable to provide a novel aerosol-generating article that provides a consumer with a choice over at least one aspect of the smoking experience delivered by the smoking article.

According to the present invention there is provided an aerosol generating article comprising an aerosol generating substrate, a mouthpiece in axial alignment with the aerosol generating substrate, and a tipping wrapper wrapped around the mouthpiece and at least a portion of the aerosol generating substrate. At least a portion of the aerosol generating substrate is circumscribed by an aerosol generating substrate wrapper. The mouthpiece comprises a mouthpiece wrapper circumscribing one or more mouthpiece segments. The tipping wrapper comprises at least one weakening line extending transversely around at least a portion of the tipping wrapper; an upstream tipping wrapper portion extending upstream from the at least one weakening line, wherein the upstream tipping wrapper portion is attached to a downstream portion of the aerosol generating substrate wrapper and an upstream portion of the mouthpiece; and a removable tipping wrapper portion extending downstream from the at least one weakening line. The mouthpiece wrapper comprises at least one surface formation underlying the removable tipping wrapper portion.

As used herein, the term "aerosol generating substrate" describes a substrate capable of releasing, upon heating (including combustion), volatile compounds, which can form an aerosol. The aerosol generated from aerosol generating substrates may be visible or invisible and may include vapours (for example, fine particles of substances, which are in a gaseous state, that are ordinarily liquid or solid at room temperature) as well as gases and liquid droplets of condensed vapours.

As used herein, the terms "upstream" and "downstream" describe the relative positions of elements, or portions of elements, of the aerosol generating article in relation to the direction in which a consumer draws on the aerosol generating article during use thereof. Aerosol generating articles as described herein comprise a downstream end (that is, the mouth end) and an opposed upstream end. In use, a consumer draws on the downstream end of the aerosol-generating article. The downstream end is downstream of the upstream end, which may also be described as the distal end. The mouthpiece is downstream of the aerosol generating substrate.

As used herein, the term "surface formation" describes a variation in a surface of the mouthpiece that results in the surface being non-uniform.

By providing at least one surface formation on a surface of the mouthpiece wrapper and underlying a removable tipping wrapper portion, aerosol generating articles according to the present invention advantageously provide a consumer with a choice over the surface texture of the aerosol generating article that contacts the their lips during smoking or otherwise using the aerosol-generating article. In particular, the consumer may choose not to remove the removable tipping wrapper portion to retain a surface texture that may be substantially the same as the surface texture of a conventional smoking article. Alternatively, the consumer may choose to remove the removable tipping wrapper portion before or during smoking to experience an alternative surface texture provided by the at least one surface formation on the underlying mouthpiece.

In aerosol generating articles according to the invention, the mouthpiece comprises one or more mouthpiece segments circumscribed by a mouthpiece wrapper. A portion of the mouthpiece wrapper underlies the removable tipping wrapper portion and is exposed at the surface of the mouthpiece upon removal of the removable tipping wrapper portion by the consumer. This portion of the mouthpiece wrapper comprises the at least one surface formation. The mouthpiece may comprise a single segment of filter material and the mouthpiece wrapper may be an individual plug wrap circumscribing the single segment of filter material. Alternatively, the mouthpiece may comprise a plurality of segments of filter material and the mouthpiece wrapper may be a combining plug wrap circumscribing the plurality of segments of filter material. In such embodiments, each of the segments of filter material may be wrapped in an individual plug wrap underlying the combining plug wrap.

The mouthpiece wrapper may be formed from a porous material, such as a porous paper. Alternatively, the mouthpiece wrapper may be formed from a non-porous material, such as a non-porous paper or a polymeric material. Suitable materials for forming the mouthpiece wrapper include cellulosic polymeric materials, starch-based polymeric materials, polyvinyl alcohol, cellophane, polylactide, and combinations thereof.

A coating may be applied to a surface of the mouthpiece wrapper adjacent to the removable tipping wrapper portion to provide a moisture barrier that may minimise the risk of a consumer's lips or mouth wetting the mouthpiece wrapper and may therefore reduce the risk of a consumer's lips or mouth sticking the mouthpiece wrapper after the removable tipping wrapper portion has been removed. For example, a lacquer, such as a lip-release lacquer, may be applied to an outer surface of the mouthpiece wrapper. Suitable lip-release lacquers include nitro-cellulose and ethyl-cellulose.

The mouthpiece wrapper may have a basis weight of less than about 90 grams per square metre, preferably less than about 60 grams per square metre, more preferably less than about 40 grams per square metre. The mouthpiece wrapper preferably has a basis weight of more than about 20 grams per square metre.

In certain preferred embodiments, the mouthpiece wrapper comprises a plug wrap or combination of plug wraps having a basis weight of between about 50 grams per square metre and about 100 grams per square metre, more preferably between about 65 grams per square metre and about 85 grams per square metre and most preferably between about 60 grams per square metre and about 70 grams per square metre. By providing a plug wrap or combination of plug wraps having a basis weight within this range, a relatively stiff mouthpiece wrapper is obtained. This advantageously provides a filter that can retain a desirable level of hardness even when the removable tipping wrapper portion has been removed.

In certain embodiments, the plug wrap may extend downstream of the mouthpiece segments to define a mouth end recess. In such embodiments, the use of a plug wrap having a relatively high basis weight as defined above advantageously helps to retain the structure of the recess during smoking.

The at least one surface formation on the mouthpiece wrapper may comprise at least one of an embossment and a debossment of the mouthpiece wrapper. Preferably, the at least one embossment or debossment comprises a depth of at least about 10 micrometres, more preferably at least about 20 micrometres, more preferably at least about 30 micrometres, which may provide a significantly different surface texture when compared to the same mouthpiece wrapper without any embossments or debossments. The at least one embossment or debossment may comprise a depth of less than about 60 micrometres, preferably less than about 50 micrometres, more preferably less than about 40 micrometres. The at least one embossment or debossment may comprise a depth of between about 10 micrometres and about 60 micrometres, preferably between about 20 micrometres and about 50 micrometres, more preferably between about 30 micrometres and about 40 micrometres.

Additionally, or alternatively, the at least one surface formation may comprise a variation in the thickness of the mouthpiece wrapper. Preferably, the variation in the thickness of the mouthpiece wrapper comprises a step change of at least about 10 micrometres, more preferably at least about 20 micrometres, more preferably at least about 30 micrometres, which may provide a significantly different surface texture when compared to a mouthpiece wrapper formed from the same material and comprising a uniform thickness. The variation in the thickness of the mouthpiece wrapper may comprise a step change of less than about 60 micrometres, preferably less than about 50 micrometres, more preferably less than about 40 micrometres. Preferably, the variation in the thickness of the mouthpiece wrapper comprises a step change of between about 10 micrometres and about 60 micrometres, preferably between about 20 micrometres and about 50 micrometres, more preferably between about 30 micrometres and about 40 micrometres.

Additionally, or alternatively, the at least one surface formation may comprise one or more materials deposited or otherwise provided on a surface of the mouthpiece wrapper. The at least one surface formation may be formed from at least one of an ink or a varnish. The material forming the at least one surface formation may be deposited on a surface of the mouthpiece wrapper using at least one of a printing process or a spraying process.

In any of the embodiments described above, the at least one surface formation may comprise a plurality of surface formations. The surface formations may comprise at least one of circles, ellipses, ovals, squares, triangles, dimples, straight lines, curved lines, zigzag lines, and combinations thereof. Additionally, or alternatively, the surface formations may form a repeating pattern.

In any of the embodiments described above, each surface formation may comprise at least one dimension of at least about 10 micrometres, preferably at least about 20 micrometres, more preferably at least about 30 micrometres. Each surface formation may comprise at least one dimension of less than about 60 micrometres, preferably less than about 50 micrometres, more preferably less than about 40 micrometres. Preferably, each surface formation comprises at least one dimension of between about 10 micrometres and about 60 micrometres, more preferably between about 20 micrometres and about 50 micrometres, more preferably between about 30 micrometres and about 40 micrometres. The at least on dimension may be at least one of height, width and length.

The mouthpiece preferably comprises a circumferential surface around which the tipping wrapper is wrapped, wherein the tipping wrapper covers the entire circumferential surface of the mouthpiece before the removable tipping wrapper portion is removed. Covering the entire circumferential surface of the mouthpiece with the tipping wrapper can provide the consumer with a choice between an entirely un-textured sensation when the removable tipping wrapper portion is not removed, and a textured sensation provided by the at least one surface formation when the removable tipping wrapper portion is removed.

The tipping wrapper of aerosol generating articles of the present invention corresponds to the outer wrapper of the mouthpiece, which circumscribes the mouthpiece and the downstream end of the aerosol generating substrate. As described above, the tipping wrapper includes an upstream tipping wrapper portion which attaches the downstream end of the aerosol generating substrate to the upstream end of the mouthpiece and which is intended to stay in place on the aerosol generating article after the removal of the removable tipping wrapper portion. The tipping wrapper further includes a downstream, removable tipping wrapper portion. Initially, the upstream tipping wrapper portion and the removable tipping wrapper portion are connected along the at least one weakening line and the tipping wrapper can be torn by the consumer along the at least one weakening line in order to remove the removable tipping wrapper portion.

The aerosol generating article is preferably free from adhesive between the removable tipping wrapper portion and the underlying portion of the mouthpiece wrapper, which may facilitate removal of the removable tipping wrapper portion.

The tipping wrapper directly overlies the mouthpiece wrapper. Preferably, the tipping wrapper is a single layer tipping wrapper which extends once around the mouthpiece in a circumferential direction. The aerosol generating articles of the present invention can therefore be formed with a similar wrapper arrangement to that of a conventional filter cigarette. The aerosol generating articles can therefore advantageously be assembled in a convenient and cost effective way using existing high speed machinery and techniques.

The removable tipping wrapper portion may extend between the at least one weakening line and a downstream edge of the tipping wrapper. In such embodiments, the removable tipping wrapper portion may extend downstream of a downstream end of the mouthpiece to define a recess at the mouth end of the aerosol generating article. This enables the downstream edge of the removable tipping wrapper portion to be grasped by the consumer so that the removable tipping wrapper portion can be readily pulled away from the mouthpiece in a downstream direction. Alternatively, the downstream edge of the removable tipping wrapper portion may coincide with the downstream end of the mouthpiece.

Alternatively, the at least one weakening line may comprise at least one upstream weakening line and at least one downstream weakening line each extending around at least a portion of the tipping wrapper and spaced apart in the downstream direction. In such embodiments, the upstream tipping wrapper portion extends upstream from the at least one upstream weakening line and the removable tipping wrapper portion extends between the at least one upstream weakening line and the at least one downstream weakening line. The tipping wrapper further comprises a downstream tipping wrapper portion extending downstream from the downstream weakening line, wherein the downstream tipping wrapper portion is attached to a downstream portion of the mouthpiece. In such embodiments, the removable tipping wrapper portion comprises a removable strip of tipping wrapper.

In any of the embodiments described above, each weakening line may comprise a single continuous cut extending around a portion of the tipping wrapper. In such embodiments, the single cut preferably extends from an edge of the tipping wrapper at a tipping wrapper seam extending along the aerosol generating article. The single continuous cut preferably extends around at least about 50 percent of the circumference of the tipping wrapper, more preferably at least about 75 percent of the circumference of the tipping wrapper, most preferably at least about 85 percent of the circumference of the tipping wrapper. Preferably, the single continuous cut extends around less than about 95 percent of the circumference of the tipping wrapper.

Alternatively, each weakening line may comprise multiple cuts spaced apart in a circumferential direction to form a row of perforations extending around the tipping wrapper. In such embodiments, the row of perforations preferably extends around substantially the entire circumference of the tipping wrapper. To aid the consumer in tearing the tipping wrapper along the row of perforations, the weakening line may comprise an elongate cut extending between an edge of the tipping wrapper at a tipping wrapper seam and the first perforation in the row of perforations.

As described above, the at least one weakening line extends transversely around at least a portion of the tipping wrapper. In some embodiments, the tipping wrapper may further comprise a longitudinal line of weakening extending along the tipping wrapper between the at least one transverse weakening line and the mouth end of the aerosol generating article to facilitate removal of the removable tipping wrapper portion. Specifically, in such embodiments, the consumer may tear the tipping wrapper along the longitudinal line of weakening first, which can provide a free edge of the tipping wrapper that the consumer can more easily grasp to subsequently tear the tipping wrapper along the at least one transverse weakening line.

In any of the embodiments described above, the tipping wrapper may comprise first and second overlapping portions that overlap to form a tipping wrapper seam extending in the longitudinal direction along the tipping wrapper. An adhesive may be provided along at least a portion of the seam to secure the first and second overlapping portions to each other.

Preferably, at least one portion of the seam comprises less adhesive across the width of the seam in the transverse direction compared to an adjacent portion of the seam in the longitudinal direction. For example, the at least one portion of the seam comprising less adhesive may comprise a layer of adhesive having a reduced thickness compared to a layer of adhesive at an adjacent portion of the seam in the longitudinal direction. Additionally, or alternatively, the at least one portion of the seam comprising less adhesive may comprise an adhesive that covers less surface area of the tipping wrapper compared to the adhesive on the adjacent portion of the seam in the longitudinal direction. Alternatively, the at least one portion of the seam comprising less adhesive may be substantially free from adhesive across the width of the seam in the transverse direction, preferably entirely free from adhesive across the width of the seam in the transverse direction.

Providing a portion of the seam that comprises less adhesive across the width of the seam in the transverse direction compared to an adjacent portion of the seam in the longitudinal direction can facilitate peeling of the tipping wrapper at the seam when removing the removable tipping wrapper portion. In those embodiments in which the at least one portion of the seam comprising less adhesive is substantially free from adhesive across the width of the seam, the at least one portion of the seam that is substantially free from adhesive may provide a free edge of the tipping wrapper that is not secured to the underlying portion of the tipping wrapper at the seam, wherein the free edge can be more easily grasped by a consumer to facilitate removal of the removable tipping wrapper portion.

Preferably the at least one portion of the seam comprising less adhesive is adjacent the at least one weakening line.

Alternatively, the adhesive may be applied along the seam at a distance from the longitudinal edge of the tipping wrapper extending along the outer surface of the mouthpiece. This provides a free edge of the tipping wrapper that is not affixed to the surface of the mouthpiece and which can be grasped by the consumer, thereby facilitating removal of the removable tipping wrapper portion.

In preferred embodiments of the present invention, the longitudinal edge of the tipping wrapper that extends along the outer surface of the mouthpiece is shaped to provide a tear tab for facilitating removal of the removable tipping wrapper portion. For example, in certain preferred embodiments, the longitudinal edge comprises a tipping wrapper projection downstream of a first weakening line on the removable tipping wrapper portion and a first straight line portion extending upstream from the tipping wrapper projection. The tipping wrapper projection comprises a first curved transition portion connecting the first straight line portion of the longitudinal edge to the remainder of the tipping wrapper projection, wherein the first curved transition portion follows a convex curve.

As used herein, the term "longitudinal" refers to the direction corresponding to the longitudinal axis of the aerosol generating article or mouthpiece. The "longitudinal edge" of the tipping wrapper refers to the free edge of the tipping wrapper that extends in a longitudinal direction between the ends of the mouthpiece, along the outer surface of the mouthpiece.

As used herein, the term "tipping wrapper projection" refers to the portion of the longitudinal edge which projects away from the first straight line portion in a circumferential direction to define a tear tab at the edge of the tipping wrapper. Typically, the tipping wrapper projection will project entirely beyond the first straight line portion, such that the tipping wrapper projection projects away from the tipping wrapper in a circumferential direction. However, in certain embodiments at least a portion of the tipping wrapper projection, for example in the region immediately adjacent the first straight line portion, may project inwardly towards the tipping wrapper in a circumferential direction.

As used herein, the term "first curved transition portion" refers to the portion of the tipping wrapper projection connecting the first straight line portion to the remainder of the tipping wrapper projection. The upstream end of the first curved transition portion corresponds to the point at which the longitudinal edge begins to curve away from the first straight line portion, as determined by the naked eye. The downstream end of the first curved transition portion corresponds to the point at which the curvature of the tipping wrapper projection changes direction from the convex curvature of the first curved transition portion, as determined by the naked eye. For example, where the tipping wrapper projection is a continuous curve, the downstream end of the first curved transition portion corresponds to the inflection point at which the curvature of the tipping wrapper projection changes from convex to concave. In other embodiments, the downstream end of the first curved transition portion may correspond to a corner where the convex curvature of the first curved transition portion changes to a linear portion.

The term "convex" is used herein to describe a portion of the tipping wrapper projection curve that has a curve with a gradient that increases as the curve moves away from the tipping wrapper in a circumferential direction. In the case of the first curved transition portion, the gradient therefore increases moving along the curve in the downstream direction. All tangents to the convex curve lie below the curve when the tipping wrapper is viewed in a flat state with the longitudinal edge incorporating the tipping wrapper projection along the top. A "convex" curve may also be described as "concave upward" or "convex downward".

The term "concave" is conversely used herein to describe a curve that has the opposite curvature to a "convex" curve and which therefore has a gradient that decreases with increasing circumferential distance from the tipping wrapper. For a concave curve, all tangents to the curve lie above the curve when the tipping wrapper is viewed in a flat state with the longitudinal edge incorporating the tipping wrapper projection along the top. A "concave" curve may also be described as "concave downward" or "convex upward".

In the tipping wrapper of the aerosol generating article of the preferred embodiments of the present invention, the first curved transition portion of the tipping wrapper projection "follows a convex curve". This is intended to cover embodiments in which the first curved transition portion is convexly curved as well as embodiments in which the first curved transition portion approximates a convex curve.

The "first straight line portion" of the longitudinal edge of the tipping wrapper extends in a straight line without curvature, substantially parallel to the longitudinal axis of the aerosol generating article.

The convex curvature of the first curved transition portion of the tipping wrapper projection, as described above, advantageously provides a gradual transition between the first straight line portion and the tipping wrapper projection and ensures that there are no sharp angles or corners in the region of the longitudinal edge where the tear tab meets the first straight line portion.

If a sharp angle or corner were to exist in this region of the longitudinal edge, a point of weakness may be created at the edge of the tipping wrapper, which could lead to undesired tearing of the tipping wrapper at this point. Conversely, in aerosol generating articles according to the present invention, the convex curvature of the first curved transition portion ensures that there should be no specific points of weakness introduced by the tipping wrapper projection, thereby minimising the risk of tearing of the tipping wrapper in the first curved transition portion. Instead, the curved shape advantageously enables the pulling force exerted by the consumer on the tear tab to be transferred more effectively to the first weakening line. The removable tipping wrapper portion can therefore be more easily removed in a single action by the consumer.

The radius of curvature of the first curved transition portion will determine the gradient of the convex curve and therefore how gradually the longitudinal edge of the tipping wrapper curves between the first straight line portion and the top of the tipping wrapper projection, wherein the "top" refers to the point furthest from the first straight line portion in a circumferential direction. The greater the radius of curvature in the first curved transition portion, the more gradually the edge curves upwards away from the first straight line portion. Preferably, the radius of curvature is at least about 0.5 mm along the length of the first curved transition portion, more preferably at least about 1 mm, most preferably at least about 2 mm. A more gradual curvature, for example, with a radius of curvature of at least 0.5 mm further minimises the risk of the tipping wrapper tearing in the first curved transition portion.

As used herein, the "radius of curvature" refers to the radius of the circle that best fits the curve at any particular point along the first curved transition portion.

The radius of curvature may be substantially constant along the first curved transition portion, for example, where the first curved transition portion approximates an arc. Alternatively, the radius of curvature may vary along the first curved transition portion but preferably remains at or above 0.5 mm at all points along the length of the first curved transition portion.

The position of the tipping wrapper projection relative to the first weakening line may also be varied in order to minimise the risk of tearing of the tipping wrapper other than along the first weakening line. Preferably, the tipping wrapper projection is provided between about 0 mm and about 15 mm downstream of the first weakening line, more preferably between about 5 mm and about 10 mm. This corresponds to the distance between the first weakening line and the upstream end of the first curved transition portion (as defined above).

Preferably, the tipping wrapper projection extends between about 2.0 mm and about 5.0 mm beyond the first straight line portion, more preferably between about 2.5 mm and about 4.0 mm beyond the first straight line portion in the circumferential direction. This corresponds to the circumferential distance between the first straight line portion and the "top" of the tipping wrapper projection as defined above, which defines the height of the tear tab relative to the straight part of the longitudinal edge.

By providing the tear tab with a height of at least 2.0 mm, the tear tab is of a convenient size for the consumer to grasp. On the other hand, keeping the height of the tear tab less than or equal to 5.0 mm may be advantageous from a manufacturing point of view. Tear tabs having a greater height will typically protrude to a larger extent from the surface of the aerosol generating article and the tear tabs of adjacent aerosol generating articles may interfere with each other during processing of the assembled aerosol generating articles. This may in turn lead to obstruction of the flow of the aerosol generating articles through the high speed apparatus. Furthermore, it may become increasingly difficult to accurately cut tear tabs having a greater height into the tipping wrapper during manufacture, due to the challenges of running the cutting knife at the same speed as the drum carrying the tipping wrapper material.

Preferably, the tipping wrapper projection extends in the circumferential direction by a distance corresponding to between about 10 percent and about 20 percent of the outer circumference of the mouthpiece.

Preferably, the width of the tipping wrapper projection in the longitudinal direction is at least about 2.5 mm. Alternatively or in addition, the width of the tipping wrapper projection in the longitudinal direction is preferably less than 15 mm.

Preferably, the width of the tipping wrapper projection in the longitudinal direction corresponds to between about 10 percent and about 50 percent of the total width of the tipping wrapper in the longitudinal direction.

The "width" of the tipping wrapper projection corresponds to the maximum dimension of the tipping wrapper projection in the longitudinal direction. The width will be measured from the upstream end of the first curved transition portion, as defined above, to the downstream end of the tipping wrapper projection. The downstream end of the tipping wrapper projection may correspond to the downstream end of the removable tipping wrapper portion or may correspond to the point at which the tipping wrapper projection connects to a second straight line portion downstream of the tipping wrapper projection, as discussed below.

Preferably, the width of the first curved transition portion in the longitudinal direction corresponds to at least about 10 percent of the distance of the tipping wrapper projection from the first weakening line.

As discussed above, the first straight line portion of the longitudinal edge of the tipping wrapper extends upstream from the tipping wrapper projection. Typically, the first straight line portion of the longitudinal edge extends to the upstream end of the tipping wrapper. Preferably, the first weakening line is provided at a position along the first straight line portion such that at least a portion of the first straight line portion is provided downstream of the first weakening line. This downstream portion of the first weakening line therefore extends between the first weakening line and the tipping wrapper projection. In alternative embodiments, the first straight line portion may be provided entirely upstream of the first weakening line, such that the upstream end of the tipping wrapper projection substantially coincides with the position of the first weakening line. In such embodiments, the tear tab is provided immediately adjacent to the first weakening line.

The tipping wrapper projection may take a variety of suitable shapes downstream of the first curved transition portion. In certain preferred embodiments, the longitudinal edge of the tipping wrapper further comprises a second straight line portion extending downstream from the tipping wrapper projection to the downstream end of the removable tipping wrapper portion. The second straight line portion is typically at substantially the same circumferential position as the first straight line portion. In these embodiments, the tipping wrapper projection preferably further comprises a second curved transition portion connecting the second straight line portion of the longitudinal edge to the remainder of the tipping wrapper projection, wherein the second curved transition portion follows a convex curve.

The position of the upstream and downstream ends of the second curved transition portion can be determined in an analogous manner to the position of the downstream and upstream ends, respectively, of the first curved transition portion, as defined above.

Preferably, the tipping wrapper projection is substantially symmetric so that the first and second curved transition portions have substantially the same curvature and dimensions as each other.

The shape of the tipping wrapper projection between the first and second curved transition portions may vary. In some embodiments, the tipping wrapper projection may incorporate a linear portion between the first and second curved transition portions so that the top edge of the tear tab is substantially flat. In alternative embodiments, the tipping wrapper projection may incorporate a curved portion between the first and second curved transition portions, for example, to form an inverted U-shaped tear tab.

Preferably, the tipping wrapper projection is a substantially continuous, smooth curve. This means that the tipping wrapper projection is preferably substantially free from linear portions and angles or corners and provides a smooth, curved edge to the tear tab. For the purposes of the present invention, a "smooth" curve is one for which every point along the curve has a unique tangent line. Preferably, the tipping wrapper projection is a symmetric curve. Alternatively, the tipping wrapper projection may be an asymmetric curve.

In certain preferred embodiments, the tipping wrapper projection follows a concave curve between the first and second curved transition portions. At the downstream end of the first curved transition portion, corresponding to a first inflection point, the curvature of the tipping wrapper projection therefore changes from convex to concave such that the tipping wrapper projection begins to curve back around towards the tipping wrapper. At a second inflection point, the curvature of the tipping wrapper projection will change back to convex and this corresponds to the upstream end of the second curved transition portion.

Preferably, the tipping wrapper projection follows a bell-shaped curve, preferably a symmetric bell-shaped curve. For example, in one particularly preferred embodiment, the tipping wrapper projection follows a normal or Gaussian-like curve. In alternative embodiments, the tipping wrapper projection may follow an asymmetric bell-shaped curve.

In alternative embodiments, the tipping wrapper projection may not include a second curved transition portion. For example, in certain preferred embodiments, the tipping wrapper projection comprises a linear portion downstream of the first curved transition portion, wherein the linear portion extends to the downstream edge of the removable tipping wrapper portion. The linear portion may be connected to the first curved transition portion at a sharp corner or vertex, or more preferably at a rounded or bevelled corner. In such embodiments, the tear tab may be elongate in shape, extending in the longitudinal direction along the removable tipping wrapper portion.

Aerosol generating articles according to the present invention may be filter cigarettes or other smoking articles in which the aerosol generating substrate comprises a tobacco material that is combusted to form smoke. Therefore, in any of the embodiments described above, the aerosol generating substrate may comprise a tobacco rod.

Alternatively, aerosol generating articles according to the present invention may be articles in which a tobacco material is heated to form an aerosol, rather than combusted. In one type of heated aerosol generating article, a tobacco material is heated by one or more electrical heating elements to produce an aerosol. In another type of heated aerosol generating article, an aerosol is produced by the transfer of heat from a combustible or chemical heat source to a physically separate tobacco material, which may be located within, around or downstream of the heat source. The present invention further encompasses aerosol generating articles in which a nicotine-containing aerosol is generated from a tobacco material, tobacco extract, or other nicotine source, without combustion, and in some cases without heating, for example through a chemical reaction.

The invention will now be further described, by way of example only, with reference to the accompanying drawings in which.

Figure 1:
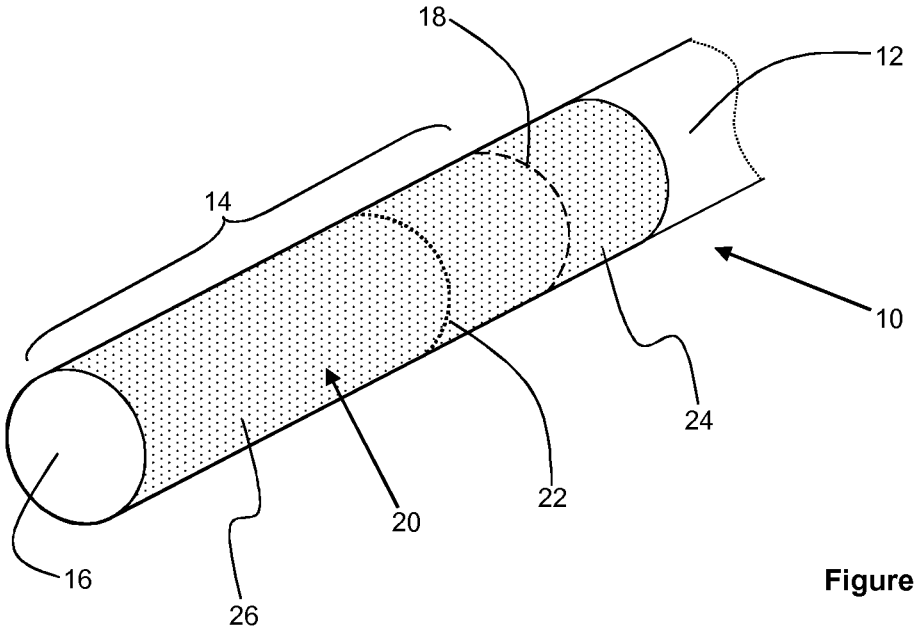
FIG. 1 shows a perspective view of an aerosol generating article in accordance with a first embodiment of the present invention.

FIG. 1 shows an aerosol generating article 10 according to a first embodiment of the present invention. The aerosol generating article 10 is a filter cigarette comprising an aerosol-generating substrate 12 in the form of a wrapped tobacco rod and a mouthpiece 14 comprising a single segment of filtration material 16 axially aligned with the tobacco rod. A downstream end of the tobacco rod abuts an upstream end of the mouthpiece 14 along the line 18 shown in FIG. 1.

A tipping wrapper 20 comprising a row of perforations that form a weakening line 22 is wrapped around the mouthpiece 14 and a portion of the tobacco rod so that an upstream tipping wrapper portion 24 extends upstream from the weakening line 22, and a removable tipping wrapper portion 26 extends downstream from the weakening line 22. Only the upstream tipping wrapper portion 24 is glued to the underlying portions of the tobacco rod and the mouthpiece 14. The removable tipping wrapper portion 26 is not glued to the underlying mouthpiece 14 and is secured to the aerosol generating article 10 only along the weakening line 22 where it is secured to the upstream tipping wrapper portion 24.

Figure 3:
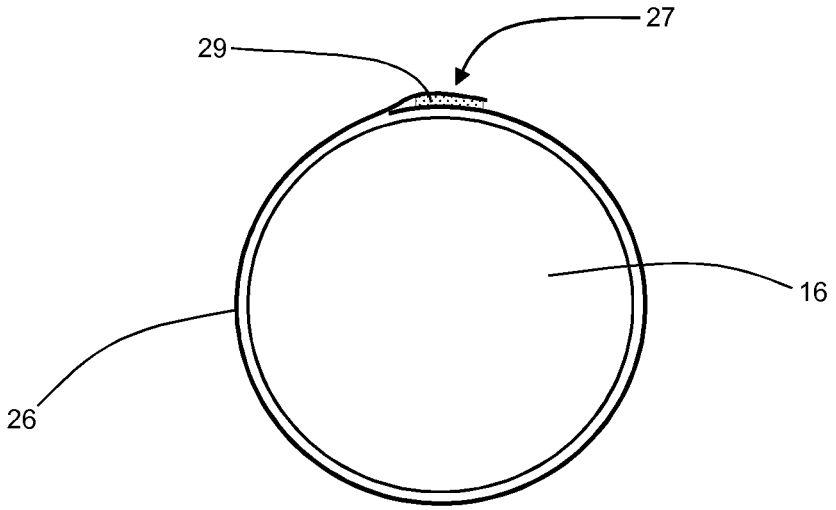
FIG. 3 shows a lateral cross sectional view of the aerosol generating article of FIG. 1 across the removable tipping wrapper portion and adjacent the downstream end of the aerosol generating article.
Figure 4:
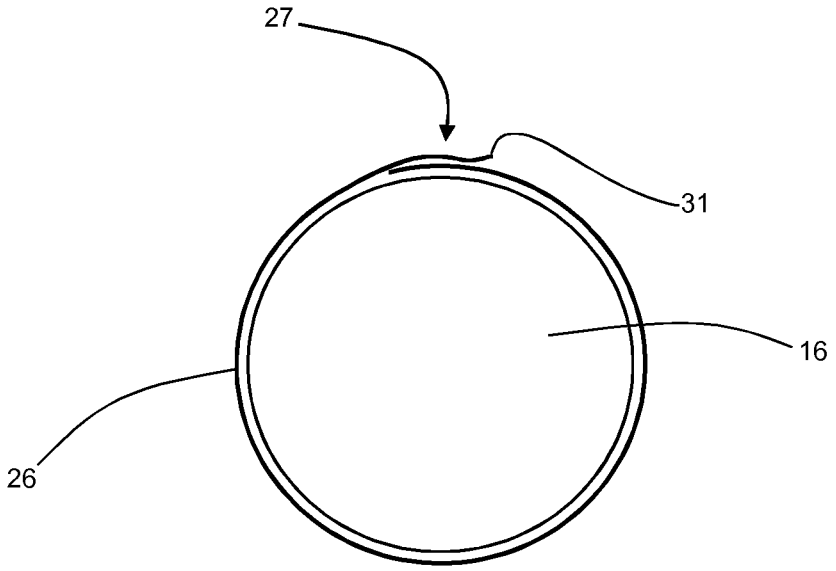
FIG. 4 shows a lateral cross sectional view of the aerosol generating article of FIG. 1 across the removable tipping wrapper portion and adjacent the weakening line.

FIG. 3 shows a transverse cross sectional view of the aerosol generating article 10 across the removable tipping wrapper portion 26 and adjacent the downstream end of the aerosol-generating article 10. During manufacture of the aerosol generating article 10, the tipping wrapper 20 is wrapped around the single segment of filtration material 16 and the aerosol-generating substrate 12 so that the transverse ends of the tipping wrapper 20 overlap to form a seam 27 along the length of the tipping wrapper 20. As shown in FIG. 3, an adhesive 29 is applied between the overlapping portions of the tipping wrapper 20 along one or more portions of the seam 27 to secure the overlapping portions of the tipping wrapper 20 together. However, as shown in FIG. 4, which shows a transverse cross sectional view of the aerosol generating article 10 across the removable tipping wrapper portion 26 and adjacent the weakening line 22, the seam 27 is substantially free from adhesive adjacent the weakening line 22 so that the overlying transverse edge of the tipping wrapper 20 forms a free edge 31 of the removable tipping wrapper portion 26 at the seam 27 and adjacent the weakening line 20. The free edge 31 forms a portion of the removable tipping wrapper portion 26 that a consumer can grasp when removing the removable tipping wrapper portion 26.

Figure 2:
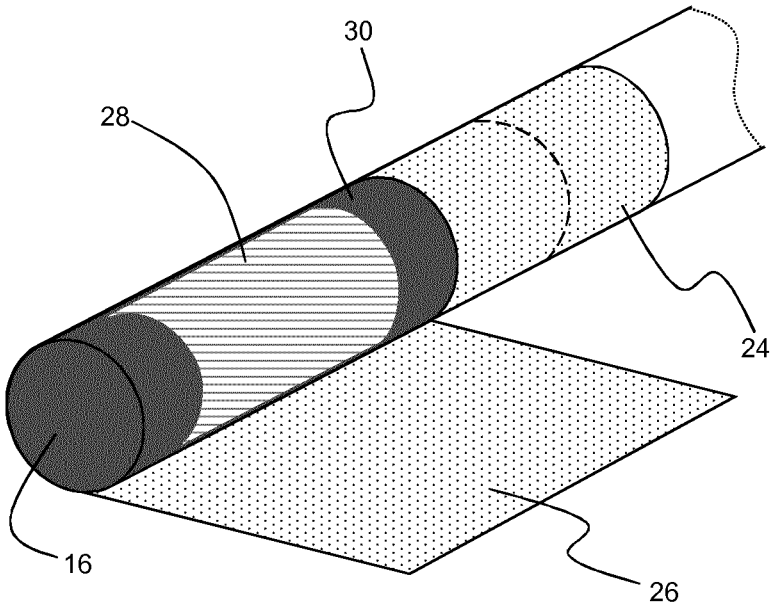
FIG. 2 shows the aerosol generating article of FIG. 1 with the removable tipping wrapper portion partially removed.

Before or during smoking of the aerosol generating article 10, the consumer can remove the removable tipping wrapper portion 26, if desired, to reveal a plurality of surface formations 28 in the form of lines embossed into a mouthpiece wrapper 30 comprising a stiff plug wrap wrapped around the single segment of filtration material 16, as shown in FIG. 2 in which the removable tipping wrapper portion 26 has been partially removed. To remove the removable tipping wrapper portion 26 the consumer can grasp the removable tipping wrapper portion 26 at the free edge 31 adjacent the weakening line 22. The consumer can then peel the removable tipping wrapper portion 26 away from the mouthpiece 14 by breaking the row of perforations forming the weakening line 22.

The stiff plug wrap forming the mouthpiece wrapper 20 maintains the required stiffness of the mouthpiece 14 after the removable tipping wrapper portion 26 has been removed.

Figure 5:
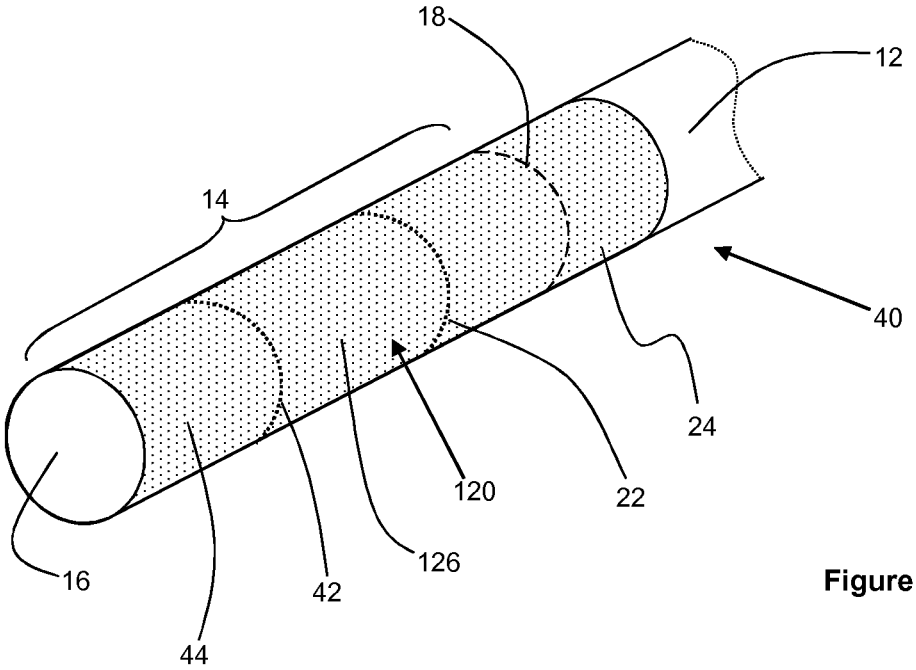
FIG. 5 shows a perspective view of an aerosol generating article in accordance with a second embodiment of the present invention.

FIG. 5 shows an aerosol generating article 40 according to a second embodiment of the present invention. The aerosol generating article 40 is a filter cigarette of similar construction to the aerosol generating article 10 shown in FIGS. 1 and 2, and therefore like reference numerals are used to designate like parts.

The aerosol generating article 40 shown in FIG. 5 differs from the aerosol generating article 10 shown in FIG. 1 in the construction of the tipping wrapper 120. Specifically, the tipping wrapper 120 of the aerosol generating article 40 comprises an additional weakening line 42 comprising a row of perforations. Therefore, the first weakening line 22 forms an upstream weakening line and the additional weakening line 42 forms a downstream weakening line. Accordingly, the tipping wrapper 120 comprises the upstream tipping wrapper portion 24 extending upstream from the upstream weakening line 22, a removable tipping wrapper portion 126 extending between the upstream and downstream weakening lines 22, 42, and a downstream tipping wrapper portion 44 extending downstream from the downstream weakening line 42. The upstream and downstream tipping wrapper portions 24, 44 are glued to the underlying portions of the tobacco rod and the mouthpiece 14. The removable tipping wrapper portion 126 is not glued to the underlying mouthpiece 14 and is secured to the aerosol generating article 10 only along the weakening lines 22, 42 where it is secured to the upstream and downstream tipping wrapper portions 24, 44.

Figure 6:
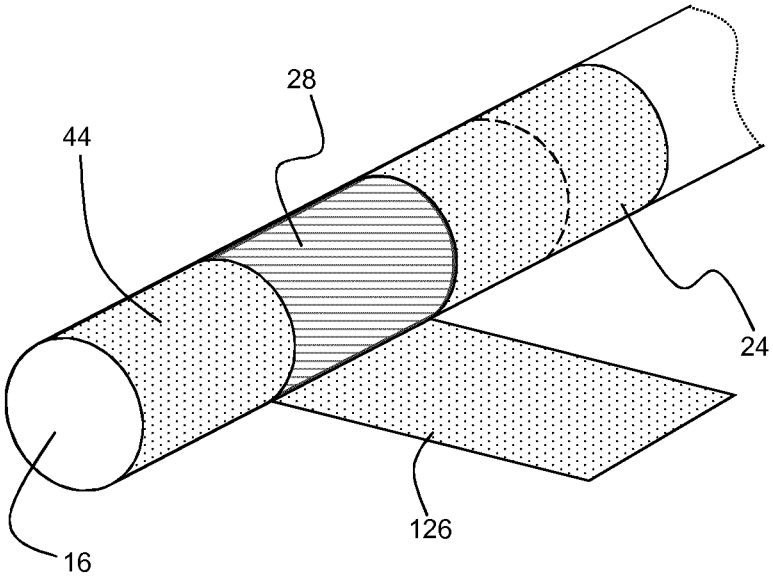
FIG. 6 shows the aerosol generating article of FIG. 5 with the removable tipping wrapper portion partially removed.

FIG. 6 shows the aerosol generating article 40 with the removable tipping wrapper portion 126 partially removed to reveal the surface formations 28 embossed into the mouthpiece wrapper 30.

Figure 7:
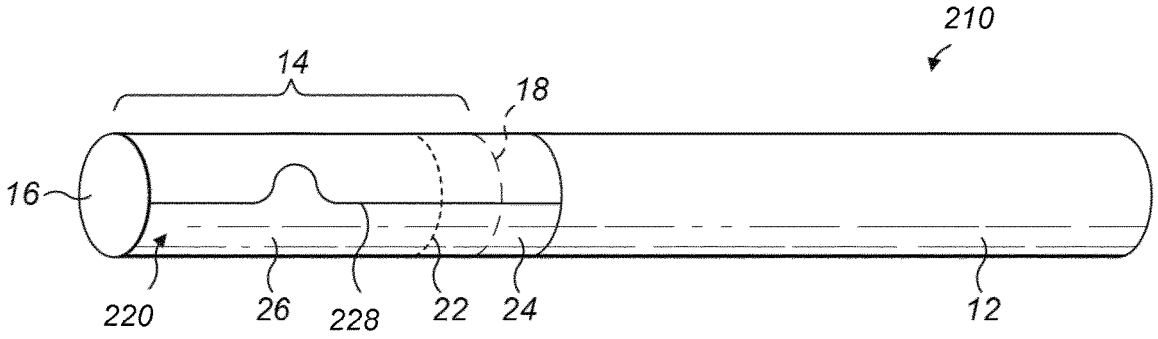
FIG. 7 shows a perspective view of an aerosol generating article in accordance with a third embodiment of the present invention.

FIG. 7 shows an aerosol generating article 210 according to a third embodiment of the present invention. The aerosol generating article 210 is a filter cigarette of similar construction to the aerosol generating article 10 shown in FIGS. 1 and 2, and therefore like reference numerals are used to designate like parts. The aerosol generating article 210 shown in FIG. 7 differs from the aerosol generating article 10 shown in FIG. 1 in that the tipping wrapper 220 comprises a tear tab 234.

The longitudinal edge 228 of the tipping wrapper 220 forms a seam extending in a longitudinal direction along the mouthpiece 14. The longitudinal edge 228 comprises a tipping wrapper projection 232 at a distance downstream of the first weakening line 22 and a first straight line portion 230 extending upstream from the tipping wrapper projection 232 to the upstream end of the tipping wrapper 220. The tipping wrapper projection 232 defines a curved tear tab 234. The longitudinal edge 228 further comprises a second straight line portion 236 extending downstream from the tipping wrapper projection 232 to the downstream end of the tipping wrapper 220. The first straight line portion 230 and the second straight line portion 236 are in line with each other, at the same position around the circumference of the mouthpiece 14.

Figure 8:
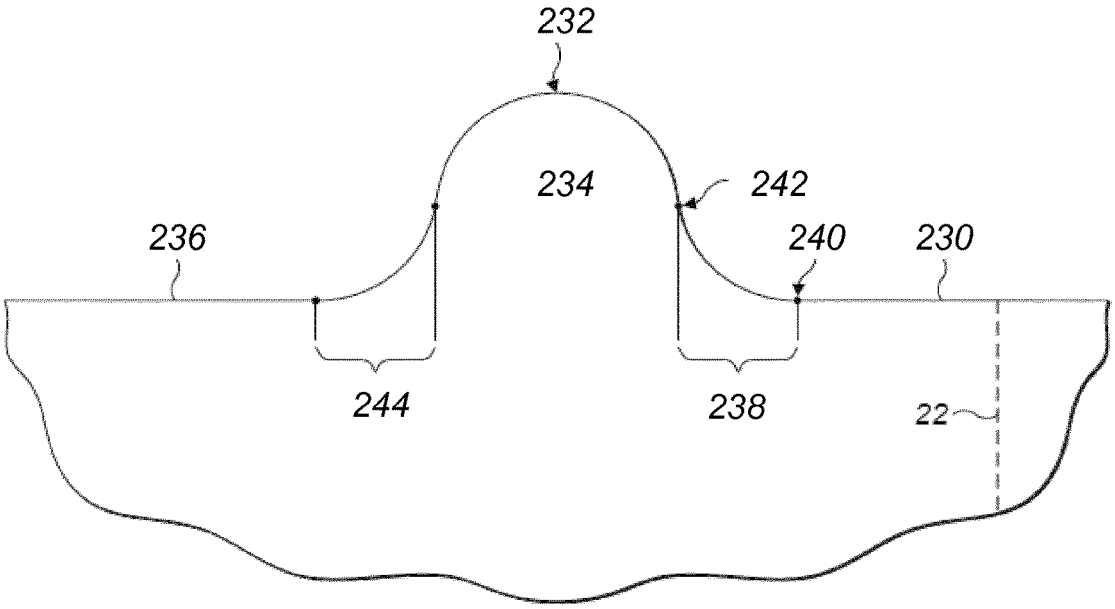
FIG. 8 shows an enlarged view of the tipping wrapper projection of the tipping wrapper of the aerosol generating article of FIG. 7.

As can be seen in the enlarged view of FIG. 8, the tipping wrapper projection 232 is in the form of a symmetric bell-shaped curve. The curve is a smooth, continuous curve such that every point on the curve has a unique tangent line. The tipping wrapper projection 232 comprises a first curved transition portion 238 connecting the first straight line portion 230 of the longitudinal edge to the remainder of the tipping wrapper projection 232. The first curved transition portion 238 is convexly curved. As shown in FIG. 6, the upstream end 240 of the first curved transition portion 238 is defined at the position where the longitudinal edge 228 begins to curve away from the first straight line portion 230. The downstream end 242 is defined as the point of inflection in the tipping wrapper projection 232 curve, where the curvature of the tipping wrapper projection 238 changes from convex to concave.

The tipping wrapper projection 232 further comprises a second curved transition portion 244 which connects the second straight line portion 236 to the remainder of the tipping wrapper projection 230. The second curved transition portion 244 has a corresponding shape to the first curved transition portion 238 due to the symmetric shape of the tipping wrapper projection 232.

Before, during or after smoking the aerosol generating article 210, the consumer can remove the removable tipping wrapper portion 26, if desired, to expose the surface projections on the underlying portion of the mouthpiece 14. To remove the removable tipping wrapper portion 26 the consumer can grasp the tear tab 234 on the removable tipping wrapper portion 26 and can then peel the removable tipping wrapper portion 26 away from the mouthpiece 14 by breaking the row of perforations forming the weakening line 22. The curved shape of the first transition region 238 of the tipping wrapper projection 232 minimises the risk of potential points of weakness existing in the region of the longitudinal edge where the tipping wrapper projection 232 meets the first straight line portion 230. This enables the force applied by the consumer to be more effectively transmitted to the weakening line 22 such that the removable tipping wrapper portion 26 can be removed in a single piece, without tearing of the tipping wrapper away from the weakening line 22.

The invention claimed is:

1. An aerosol generating article comprising:

an aerosol generating substrate, at least a portion of which is circumscribed by an aerosol generating substrate wrapper;

a mouthpiece in axial alignment with the aerosol generating substrate, the mouthpiece comprising a mouthpiece wrapper circumscribing one or more mouthpiece segments; and a tipping wrapper wrapped around the mouthpiece and at least a portion of the aerosol generating substrate, the tipping wrapper comprising:

at least one weakening line extending transversely around at least a portion of the tipping wrapper;

an upstream tipping wrapper portion extending upstream from the at least one weakening line, wherein the upstream tipping wrapper portion is attached to a downstream portion of the aerosol generating substrate wrapper and an upstream portion of the mouthpiece; and a removable tipping wrapper portion extending downstream from the at least one weakening line, wherein the mouthpiece wrapper comprises at least one surface formation underlying the removable tipping wrapper portion, and wherein the at least one surface formation comprises at least one of an embossment and a debossment of the mouthpiece wrapper, the at least one of an embossment and a debossment having a depth of 10 μm or greater and providing a surface texture different from a surface texture of the removable tipping wrapper portion.

2. An aerosol generating article according to claim 1, further comprising a lacquer provided on a surface of the mouthpiece wrapper adjacent the removable tipping wrapper.

3. An aerosol generating article according to claim 1, wherein the at least one surface formation comprises a variation in the thickness of the mouthpiece wrapper.

4. An aerosol generating article according to claim 1, wherein the at least one surface formation comprises a repeating pattern of surface formations.

5. An aerosol generating article according to claim 1, wherein the mouthpiece comprises a circumferential surface around which the tipping wrapper is wrapped, and wherein the tipping wrapper covers the entire circumferential surface of the mouthpiece before the removable tipping wrapper portion is removed.

6. An aerosol generating article according to claim 1, wherein the removable tipping wrapper portion extends between the at least one weakening line and a downstream edge of the tipping wrapper.

7. An aerosol generating article according to claim 6, wherein the downstream tipping wrapper portion extends downstream of a downstream end of the mouthpiece to define a recess at the mouth end of the aerosol generating article.

8. An aerosol generating article according to claim 1, wherein the at least one weakening line comprises at least one upstream weakening line and at least one downstream weakening line each extending around at least a portion of the tipping wrapper and spaced apart in the downstream direction, wherein the upstream tipping wrapper portion extends upstream from the at least one upstream weakening line, wherein the removable tipping wrapper portion extends between the at least one upstream weakening line and the at least one downstream weakening line, wherein the tipping wrapper further comprises a downstream tipping wrapper portion extending downstream from the at least one downstream weakening line, and wherein the downstream tipping wrapper portion is attached to a downstream portion of the mouthpiece.

9. An aerosol generating article according to claim 1, wherein the tipping wrapper comprises first and second overlapping portions that overlap to form a tipping wrapper seam extending in the longitudinal direction along the tipping wrapper, the aerosol generating article further comprising an adhesive provided along at least a portion of the seam to secure the first overlapping portion to the second overlapping portion, and wherein at least one portion of the seam comprises less adhesive across the width of the seam in the transverse direction compared to an adjacent portion of the seam in the longitudinal direction.

10. An aerosol generating article according to claim 1, wherein the aerosol generating article is free from adhesive between the removable tipping wrapper portion and the underlying portion of the mouthpiece.

11. An aerosol generating article according to claim 1, wherein the mouthpiece wrapper comprises one or more plug wraps circumscribing one or more segments of filter material.

12. An aerosol generating article according to claim 1, wherein the tipping wrapper comprises a longitudinal edge extending along the outer surface of the mouthpiece, the longitudinal edge comprising a tipping wrapper projection downstream of the at least one weakening line on the removable tipping wrapper portion and a first straight line portion extending upstream from the tipping wrapper projection, wherein the tipping wrapper projection comprises a first curved transition portion connecting the first straight line portion of the longitudinal edge to the remainder of the tipping wrapper projection and wherein the first curved transition portion follows a convex curve.

13. An aerosol generating article according to claim 12 wherein the radius of curvature is at least 0.5 mm along the length of the first curved transition portion.

* * * * *